US010459406B2

(12) United States Patent
Di Domenico et al.

(10) Patent No.: US 10,459,406 B2
(45) Date of Patent: Oct. 29, 2019

(54) INTERACTION BETWEEN TWO TIMEPIECE COMPONENTS

(71) Applicant: The Swatch Group Research and Development Ltd, Marin (CH)

(72) Inventors: Gianni Di Domenico, Neuchatel (CH); Jean-Luc Helfer, Le Landeron (CH); Pascal Winkler, St-Blaise (CH); Jerome Favre, Neuchatel (CH)

(73) Assignee: The Swatch Group Research and Development Ltd, Marin (CH)

( * ) Notice: Subject to any disclaimer, the term of this patent is extended or adjusted under 35 U.S.C. 154(b) by 136 days.

(21) Appl. No.: 15/317,313

(22) PCT Filed: Jun. 19, 2015

(86) PCT No.: PCT/EP2015/063872
§ 371 (c)(1),
(2) Date: Dec. 8, 2016

(87) PCT Pub. No.: WO2016/045806
PCT Pub. Date: Mar. 31, 2016

(65) Prior Publication Data

US 2017/0123379 A1 May 4, 2017

(30) Foreign Application Priority Data

Sep. 25, 2014 (EP) ..... 14186296

(51) Int. Cl.
*G04B 15/00* (2006.01)
*G04C 3/04* (2006.01)
(Continued)

(52) U.S. Cl.
CPC ..... *G04C 3/047* (2013.01); *G04B 15/08* (2013.01); *G04B 15/14* (2013.01); *G04C 3/105* (2013.01); *G04C 5/005* (2013.01)

(58) Field of Classification Search
CPC ..... G04B 15/08; G04B 15/14; G04B 15/10; G04B 5/00; G04C 5/005; G04C 3/047; G04C 3/105
See application file for complete search history.

(56) References Cited

U.S. PATENT DOCUMENTS 3,183,426 A * 5/1965 Haydon ..... G04C 5/005 368/132
3,451,280 A * 6/1969 Hetzel ..... G04B 11/04 368/125
(Continued)

FOREIGN PATENT DOCUMENTS

EP 2 463 732 A1 6/2012

OTHER PUBLICATIONS

International Search Report dated Mar. 10, 2016 in PCT/EP2015/063872 filed Jun. 19, 2015.

*Primary Examiner* — Sean P Kayes
(74) *Attorney, Agent, or Firm* — Oblon, McClelland, Maier & Neustadt, L.L.P.

(57) ABSTRACT

A timepiece mechanism including a first component and a second component configured to cooperate with each other in a relative motion on a trajectory in an interface area, wherein a first path of the first component includes magnetic and/or electrostatic actuation components, configured to exert a contactless stress on complementary magnetic and/or electrostatic actuation components included in a second path belonging to the second component. Throughout a monotonous relative movement of the second path with respect to the first path, interaction energy between the first component and second component has a variable gradient with at least one position of discontinuity of the gradient, which corresponds to a variation in the contactless stress, the position of
(Continued)

discontinuity of the gradient corresponding, in a variant, to an abrupt variation in the contactless stress.

19 Claims, 6 Drawing Sheets

(51) Int. Cl.

| | |
|---|---|
| ***G04C 3/10*** | (2006.01) |
| ***G04C 5/00*** | (2006.01) |
| ***G04B 15/08*** | (2006.01) |
| ***G04B 15/14*** | (2006.01) |

(56) References Cited

U.S. PATENT DOCUMENTS

| | | | | |
|---|---|---|---|---|
| 3,652,955 | A * | 3/1972 | Cruger | G04C 3/024 310/25 |
| 8,559,277 | B2 * | 10/2013 | Karapatis | G04B 21/06 116/152 |
| 9,746,829 | B2 * | 8/2017 | Stranczl | G04C 5/005 |
| 9,927,773 | B2 * | 3/2018 | Di Domenico | G04C 5/005 |
| 2012/0147715 | A1 | 6/2012 | Karapatis et al. | |
| 2015/0177690 | A1 * | 6/2015 | Di Domenico | G04C 3/105 368/126 |
| 2016/0070235 | A1 * | 3/2016 | Mignot | G04C 5/005 368/126 |
| 2016/0327908 | A1 * | 11/2016 | Winkler | G04C 5/005 |

* cited by examiner

Fig. 26
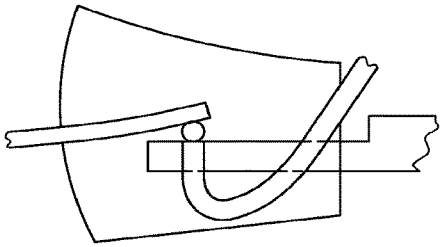
Fig. 27
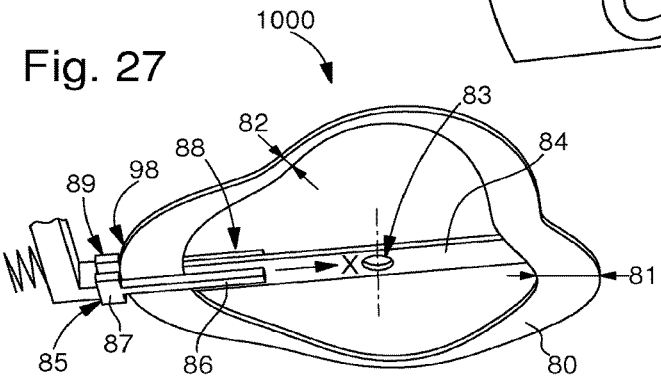
Fig. 31
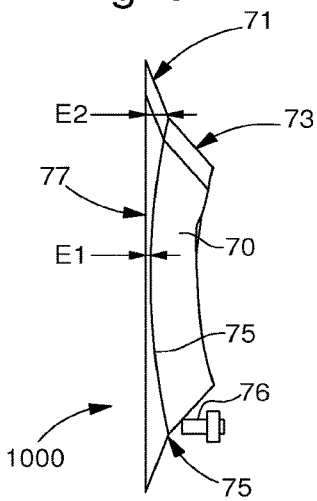
Fig. 28
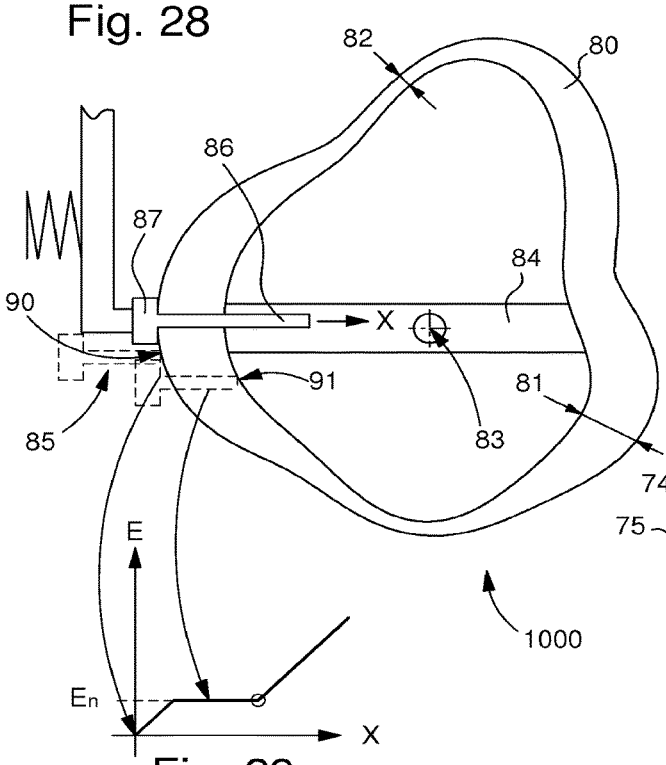
Fig. 29
Fig. 30
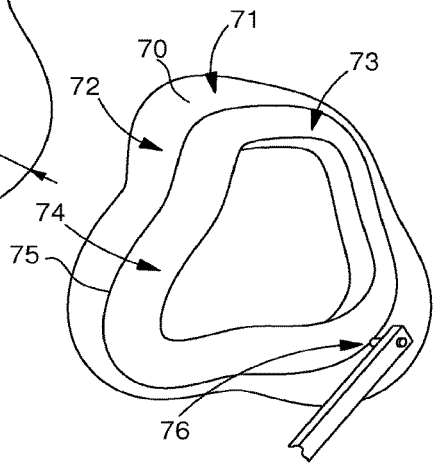

INTERACTION BETWEEN TWO TIMEPIECE COMPONENTS

FIELD OF THE INVENTION

The invention concerns a timepiece mechanism comprising at least a first component and a second component which are arranged to cooperate with each other in a relative motion on a trajectory in an interface area wherein a first path of said first component comprises first actuation means which are arranged to exert a contactless stress on second complementary actuation means comprised in a second path belonging to said second component.

The invention also concerns a timepiece comprising at least one such mechanism.

The invention concerns the field of timepiece mechanisms.

BACKGROUND OF THE INVENTION

Mechanical horology mainly uses friction contacts for transmitting a motion or a force from one component to another, for example in gear wheels, jumper springs, escapement components or other elements. The main defects of such friction contacts are energy losses due to friction, and the relation between the transmission of motion and the transmission of stress. For example, when two components each pivot about an axis, with the two components in contact with each other, if the angular velocity increases from the first to the second component, then the torque decreases from the first to the second component. This law is always valid, and not just on average. It follows from conservation of energy.

SUMMARY OF THE INVENTION

The invention proposes to achieve optimised energy transmission between the components of a timepiece mechanism. This energy transmission concerns, in particular, a transmission of motion or a transmission of stress in a contactless manner.

BRIEF DESCRIPTION OF THE DRAWINGS

Other features and advantages of the invention will appear upon reading the following detailed description, with reference to the annexed drawings, in which:

FIG. 8 represents a first component of any contour and of constant thickness, and a second component consisting of two masses joined end to end, in a position corresponding to the energy gradient discontinuity threshold where the edge of the first component is positioned at the boundary between the two masses.

FIG. 9 illustrates a similar configuration to FIG. 8, wherein the two masses are of the same width but of different height.

FIG. 10 represents the mechanism according to the invention of the type with cam-to-cam transmission, with particular peripheral contours of the first component and of the second component, here with the first component extending over a first level, and the second component comprising a first level and a second level, which are superposed and one extending beyond another in places, in a position corresponding to the energy gradient discontinuity threshold wherein the edge of the first component is positioned plumb with the edge of one of the two levels of the second component.

FIG. 11 represents the combination of a first extended component which comprises a first level and a second level, which are superposed and extend beyond each other in places, and a second substantially punctiform component at the end of an arm, in a position where the second substantially punctiform component is positioned plumb with the edge of one of the two levels of the first component.

FIG. 12 is a diagram corresponding to FIG. 11, showing the two slopes of energy interaction, with the height of the first component on the ordinate, and the radial coordinate on the abscissa.

FIG. 13 illustrates a variant close to that of FIG. 11, with the same first component, and a second component which carries an element having a curvilinear contour.

FIG. 14 is a similar diagram to FIG. 12, concerning the mechanism of FIG. 13.

FIGS. 15 to 19 more particularly concern the transmission of a stress independent of the motion of the components of the mechanism:

FIG. 15, like FIG. 1, represents the accumulated energy which can be returned, and which corresponds to the energy level at the break in the slope close to the transition value that corresponds to the discontinuity in the energy gradient.

FIG. 16, like FIG. 2, shows, on the ordinate, the useful stress range which corresponds to the difference, on the ordinate, between the stress levels of the two different energy gradient areas, and shows, on the abscissa, the area of useful mechanical motion, which includes an accumulation area, and a narrow positioning area, close to this transition value.

FIG. 17 shows the opposite configuration to FIG. 16, where the stress levels are positive.

FIG. 18 shows a transformation based on the mechanism of FIG. 8, where the first component 1 comprises two areas of different thickness, between which lies a transition area.

FIG. 19 represents a combination of the first component of FIG. 8, and the second substantially punctiform component of FIG. 12; one of the slopes is then zero, the interaction between the two components is one of attraction here, whereas in the embodiments of the other Figures the interaction is one of repulsion.

FIG. 20 shows a gear, wherein the first component and the second component are both comparable to toothed wheels, the first component comprises protuberances, which cooperate with a series of notional teeth, mounted on spokes, of the second component, each of the notional teeth comprising two masses similar to those of FIG. 8, and which cooperate with the edge of the first component in a similar manner to that described above in FIG. 8.

FIG. 21 represent a detail of a jumper spring cooperating with a disc or star of a date mechanism, the first component comprises protuberances, which cooperate with a palletstone formed by a second component with two levels as in FIG. 10.

FIG. 22 represents a first circular component whose pivoting is guided between second fixed components each acting as a peripheral runner and each comprising two masses similar to those of FIG. 8, and which cooperates with the edge of the first component in a similar manner to that of FIG. 8.

FIG. 23 combines the guiding function of FIG. 22 and a jumper spring function, the first component comprising for this purpose alternating sectors of different levels, as in the embodiment of FIG. 11.

FIG. 26 represents a schematic plan view of an application of the invention to the winding of a strike hammer and to the protection thereof against rebound.

FIG. 27 illustrates, in perspective, the cooperation between, on the one hand, a flat cam of variable radial cross-section, pivoting about a pivot carried by an arm, and on the other hand, a T-shaped actuator on either side of the cam periphery, the vertical bar of the T being superposed on the cam periphery, and the cross-bar marking a stop at the edge of the cam.

FIG. 28 is a plan view of this assembly, with a view, in dotted lines and in dot and dash lines, of two different relative positions of the T with respect to the cam;

FIG. 29 is a diagram representing the energy level variation as a function of relative penetration X.

FIGS. 30 and 31 illustrate, in perspective and in a side view, a three-dimensional cam with both radial and height variations, wherein two warped surfaces intersect at a warped interface curve, the cam being shown cooperating with a cylindrical type feeler-spindle.

DETAILED DESCRIPTION OF PREFERRED EMBODIMENTS

Figure 1:
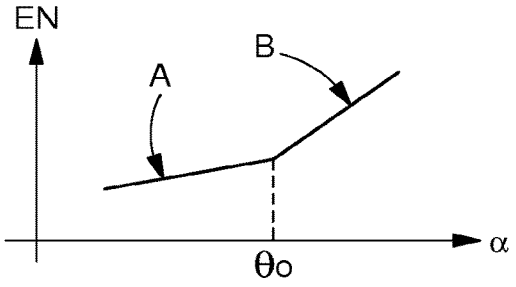
FIG. 1 is a diagram representing the energy variation of a mechanism according to the invention comprising two components that are movable with respect to each other and comprising contactless means for applying stress, as a function of the relative variation in one degree of freedom of one of the two components with respect to the other, and shows a discontinuity in the gradient of energy at a given value.

The invention proposes to achieve optimised energy transmission between the components of a timepiece mechanism. This energy transmission concerns, in particular, a transmission of motion or a transmission of stress in a contactless manner.

The term "stress" in the following description refers equally to a torque, a force, and to a force torsor combining at least one torque and at least one force.

The invention is applicable in three-dimensional space. For ease of illustration, the examples are two-dimensional, but it should be understood that the invention is applicable to any number of degrees of freedom, and not simply in the same plane. It is thus applicable, in particular, for pivoting, rotational, translational motions and combined motions, such as, for example, the pivoting of a wheel set combined with a movement of translation, such as for a winding stem or suchlike.

The term "wheel set" in the following description means any component capable of effecting any type of motion, and not merely a rotating or pivoting component as is usually understood in watchmaking.

It is an object of the invention to permit the transmission of a stress from one component to another without energy losses due to friction, and with kinematics independent of the transmitted stress. In short, it concerns the separation of the conventional connection between, on the one hand, transmission of motion and in particular of velocity, and on the other hand, transmission of stress or torque.

To this end, the invention utilises the remote transmission of stress.

More particularly, the use of magnetic and/or electrostatic fields makes it possible to generate forces of repulsion and/or attraction between at least two components, which allows for transmission of a motion or stress in a contactless manner between two of these components, and thus eliminates energy losses due to friction. Further, the magnetic and/or electrostatic interaction between the two components makes it possible to store energy at a given moment and to form an energy storage buffer for temporary energy storage, and then subsequently to return the energy. The invention proposes particularly to determine in an extremely precise manner the conditions for this restitution of energy, which may be carried out one or more times. This means that the stored energy is that of the "first component+second component+interaction" set and not simply from the "first component+second component", which allows the transmission of a motion to be separated from the transmission of a stress by temporarily storing energy in the "interaction". A mechanical analogy might consist in using a buffer spring between two components.

Hereafter the "active part" of a wheel set refers to an area transmitting a magnetic or electrostatic field, or an area made of a material or with a treatment enabling it to react to such a field.

Magnetic interactions between two components have already been proposed in mechanical horology. However, the main defect of such magnetic interactions is that the kinematics depend on the stress, force or torque exerted on the components. In other words, the transmitted motion depends on the transmitted force or torque.

Figure 2:
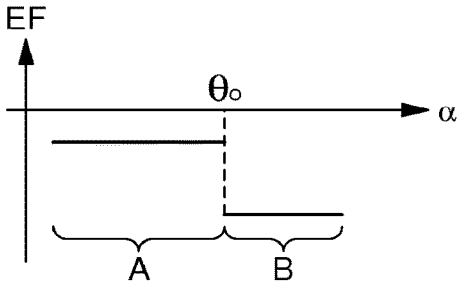
FIG. 2 is a diagram representing, for the mechanism of FIG. 1, the variation in the reaction stress experienced by the component that is movable with respect to the other, as a function of the relative variation in the same degree of freedom, and shows an abrupt variation in said stress for the energy gradient discontinuity value of FIG. 1.

It is an object of the present invention to overcome this latter defect. Indeed, through a careful choice of the magnetic or electrostatic interaction potential between these two components, it is possible to obtain kinematics independent of the transmitted stress, force or torque. To clarify this potential, FIGS. 1 and 2 illustrate the general principle, in its application to a non-limiting example of two components pivoting in a plane about two distinct axes. If the angle of the first component 1 is fixed, FIG. 1 shows, on the ordinate, the change in interaction energy EN as a function of the relative angle α formed by second component 2 with first component 1 when second component 2 pivots. A first area A of stress (a torque here in this particular example) corresponds to a substantially linear increase in interaction energy EN as a function of angle α on a first slope up to an angle of transition θ0, and is followed by a second area B of stress which corresponds to a substantially linear increase in interaction energy E as a function of angle α on a second slope, which has a higher absolute value than the first slope. The reaction stress experienced by second component 2 is represented in the FIG. 2 diagram, with stress EF on the ordinate, and the same angle α on the abscissa: a first portion corresponds to a first stress A, a substantially constant torque here, followed by a second portion with a second substantially constant stress B, with the change from one stress level to the other occurring close to transition angle θ0. Stress EF, which is a torque here, has an absolute value equal to that of the derivative of energy with respect to the degree of freedom concerned; in the present example, the degree of freedom is angular, the value is that of the derivative of energy EN with respect to angle α.

Thus, if a positive torque C is applied to second component 2, where |torque A|<torque C<|torque B|, then second component 2 will adjust itself at transition angle $\theta_o$. It is seen that this angle $\theta_o$ is independent of torque C, at any rate for a certain range of torque C.

In its most general terms, the invention concerns a timepiece mechanism 1000 comprising at least a first component 1 and a second component 2. This at least a first component 1 and this at least a second component 2 are arranged to cooperate with each other in a relative motion on a trajectory in an interface area 3.

First component 1 comprises a first path 100 which comprises first actuation means 110. Second component 2 comprises a second path 200 which comprises second complementary actuation means 210. First actuation means 110 are arranged to exert a contactless stress on second complementary actuation means 210, or vice versa.

According to the invention, throughout a monotonous relative movement of second path 200 with respect to first path 100, the interaction energy between first component 1 and second component 2 has a variable gradient with at least one position of discontinuity, which corresponds to a variation in the contactless stress.

More particularly, the interaction energy between first component 1 and second component 2 has a non-zero and variable gradient, with at least one position of discontinuity that corresponds to a variation in the contactless stress.

First actuation means 110 and second complementary actuation means 210 are respectively chosen to be active and passive magnetic and/or electrostatic actuation components, or vice versa.

In a particularly advantageous manner, this position of discontinuity of the gradient corresponds to an abrupt variation in the contactless stress, as seen in FIG. 2 at transition angle θ0.

In a particular variant, one such first component 1 and one such second component 2 are arranged to cooperate with each other in a relative motion on a repetitive trajectory in a predefined interface area 3.

In a particular variant, second complementary actuation means 210 comprise at least one area of penetration 30, which is close to and distinct from a blocking area 40. Penetration area 30 and blocking area 40 cooperate differently with first actuation means 110.

A break in the slope at the boundary between penetration area 30 and blocking area 40, and connected to each of the latter, corresponds to a position of discontinuity of the gradient.

More particularly, this break in the slope is a barrier area 50 which corresponds to the position of discontinuity of the gradient.

Figure 7:
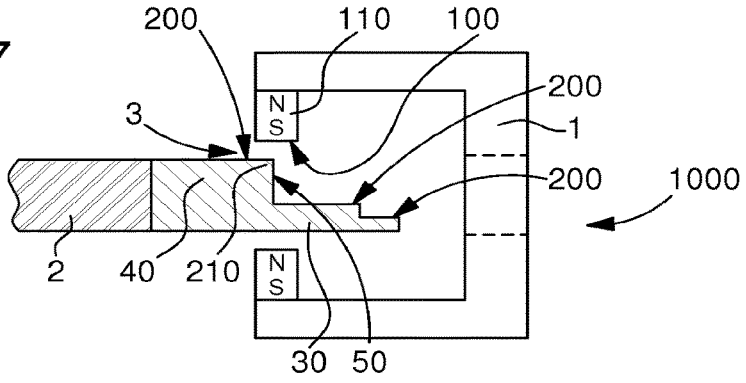
FIG. 7 represents a schematic, partial and cross-sectional view of a timepiece mechanism according to the invention comprising magnets on a first component with a U-shaped profile, and a ferromagnetic area with stepped sections on one end of a second component, the first and second components are represented in a position corresponding to the energy gradient discontinuity threshold.
Figure 18:
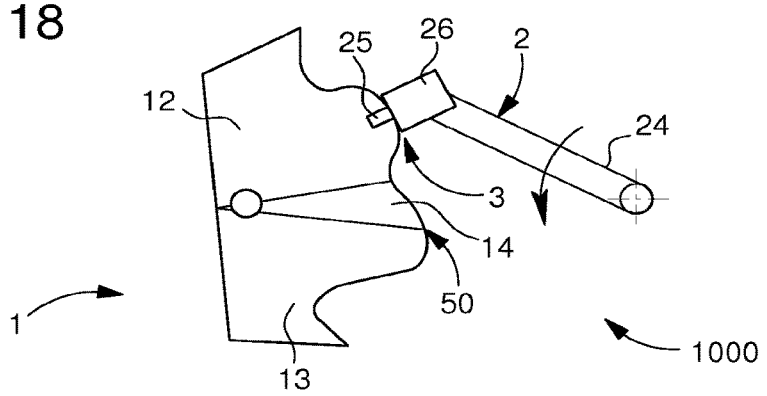
Figure 19:
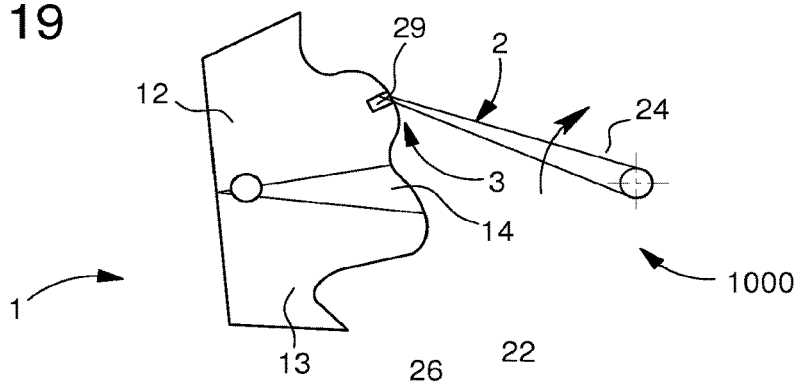

This break in the slope, or barrier area 50, may simply consist of a front at the boundary between two masses of different properties, as in FIG. 7, or a progressive area, such as area 14 of FIG. 18 or 19, represented in that case on first component 1, since, evidently, first component 1 and second component 2 can each comprise the various features that are illustrated here simply for particular non-limiting cases. First actuation means 110 can thus also include at least one penetration area 30, which is close to and distinct from a blocking area 40. Penetration area 30 and blocking area 40 cooperate differently with the second complementary actuation means 210, and are also separated by a barrier area 50, similar to that described above.

In a particular variant, the cooperation between first actuation means 110 and second complementary actuation means 210 makes it possible, in certain first relative positions of first component 1 and of second component 2, to synchronize their speed or position, and, in certain other second relative positions of first component 1 and of second component 2, to allow one of the two components to move with respect to the other under the action of a stress (torque and/or force).

In a particular variant, at least in proximity to a limit position, first actuation means 110 exert a first substantially constant stress on penetration area 30.

In a particular variant, at least in proximity to a limit position, first actuation means 110 exert a second substantially constant stress on blocking area 40.

In a particular variant, in proximity to this limit position, a particular curvilinear contour of first component 1 faces a barrier area 50, as described above, of second component 2.

More particularly, mechanism 1000 comprises one such first component 1 and one such second component 2, which are arranged to effect a relative motion in a useful area which comprises a first part corresponding to a first stress area in which the relative stress or torque exerted by one of these components 1, 2, on the other is at a first level. This useful area comprises a second part which corresponds to a second stress area in which the relative torque or stress exerted by one of these components 1, 2, on the other is at a second level, different from the first level, at least in places around a given position, such that, at the interface at the boundary between the first stress area and the second stress area, first component 1 and second component 2 are precisely positioned with respect to each other, for a range of useful stress, particularly of determined torque.

More particularly, in the first stress area the relative torque or stress exerted by one of components 1, 2 on the other is substantially constant at the first level, and in the second stress area the relative torque or stress exerted by one of components 1, 2, on the other is substantially constant at the second level, which is different from the first level.

In particular, the interaction energy gradient between first component 1 and second component 2 is greater in this second stress area than that in the first stress area.

In a variant embodiment that is easy to industrialise, at least a first component 1 and at least a second component 2 interact with each other via the action of magnetic or respectively electrostatic fields, and the first stress area corresponds to an accumulation of magnetic or respectively electrostatic energy during a relative motion between first component 1 and second component 2.

More particularly, the energy accumulated in the first stress area, during the monotonous relative motion of second path 200 with respect to first path 100, up to the position of discontinuity of the energy gradient, is constant and fixed by the design of mechanism 1000. When this position of discontinuity of the gradient is crossed, the stored energy is returned in the same degree of freedom or in at least one other degree of freedom.

In particular, in the first stress area and the second stress area, the interaction energy gradient between first component 1 and second component 2 is created by the continuous variation of a physical parameter that contributes to the magnetic or respectively electrostatic interaction between first component 1 and second component 2.

More particularly, the position of discontinuity of the gradient, which corresponds to a variation in contactless stress, is that at the start, or at the end, of the driving of one of first component 1 and second component 2 by the other.

Figure 3:
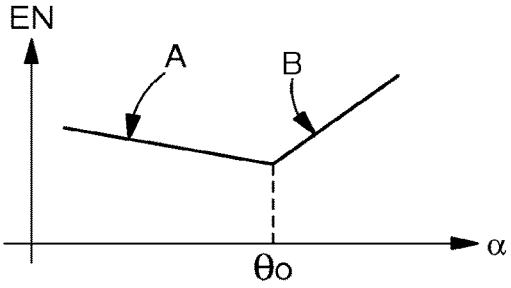
FIGS. 3 and 4 illustrate, in a similar manner to FIGS. 1 and 2, the case of positioning of a second component to which no torque is applied, consequently the energy gradients on either side of the threshold are of opposite signs to each other.
Figure 4:
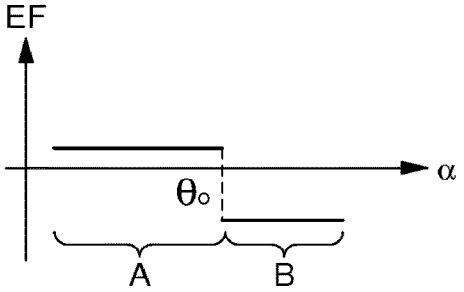

FIGS. 3 and 4 illustrate, in a similar manner to FIGS. 1 and 2, the case of positioning of a second component 2 to which no torque is applied. In this case, the energy diagram of FIG. 3 shows a first stress area A and a second stress area B, delimited by an angle of transition θ0, and which have two slopes of different signs. FIG. 4 shows the stress levels, which are also of opposite signs, and which tend always to return second component 2 to the angular position that corresponds to angle of transition θb 0.

Figure 5:
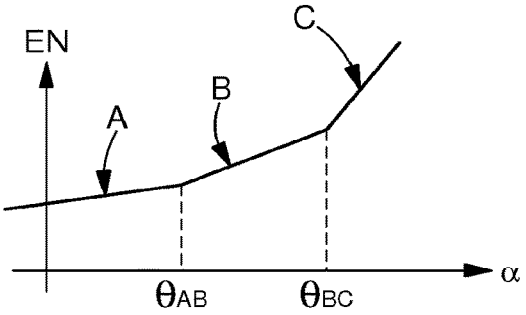
FIGS. 5 and 6 illustrate, in a similar manner to FIGS. 1 and 2, the generalisation to several breaks in the slope, between different gradient ranges.
Figure 6:
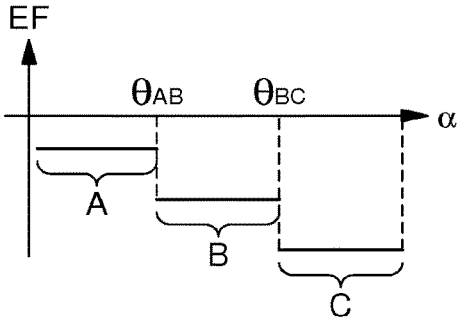

FIGS. 5 and 6 illustrate the generalisation to several breaks in the slope to obtain a positioning of the component which is a function of the range of stress, here of torque. FIG. 5 shows the series of stress areas A, B, C, having different slopes, and delimited by intermediate angles θAB and θBC: FIG. 6 shows that, if the stress on second component 2 is such that

|torque A|<torque component 2<|torque B|, second component 2 is positioned at θAB, whereas if

|torque A|<torque component 2<|torque B|, component 2 is positioned at θBC. This reasoning can of course be extrapolated to any number of stress ranges.

FIG. 7 illustrates an example embodiment of a timepiece mechanism 1000 with magnetic elements on a first component 1 and on a second component 2 comprised therein. This first component 1 and second component 2 are arranged to cooperate with each other in a relative motion on a trajectory in an interface area 3, wherein a first path 100 of first component 1 comprises first actuation means 110, of the magnet type here, arranged to exert a contactless stress on second complementary actuation means 210, formed by a ferromagnetic area here, comprised in a second path 200 belonging to second component 2. According to the invention, throughout the monotonous relative motion of second path 200 with respect to said first path 100, the interaction energy between first component 1 and second component 2 has a non-zero and variable gradient with at least one position of discontinuity, which corresponds to a variation in the contactless stress. Second path 200 is stepped here, and consequently the magnetic interaction is variable during the relative movement of insertion or removal of second component 2 with respect to first component 1.

Different variant embodiments of FIG. 7 can be envisaged, in particular:

first component 1 as a magnet and second component 2 made of soft iron, or first component 1 as a magnet and second component 2 as a magnet, or first component 1 made of soft iron and second component 2 as a magnet.

Still referring to the arrangement of FIG. 7, it is possible to vary the geometry of the magnetic elements in the plane perpendicular to the axis of rotation of first component 1 or of second component 2, depending on the case, or to vary the thickness of the magnetic elements parallel to the axis of rotation. In a first approximation, the interaction potential can be estimated, if the air gap is small, by an energy proportional to the product of the surface of intersection between first component 1 and second component 2, by the height of first component 1 in the area of intersection and interface 3, by the height of second component 2 in the area of intersection and interface 3.

FIGS. 8 to 23 are very schematic illustrations of simple and non-limiting examples of variant implementations of the invention, in plane configurations wherein the two areas having different energy gradients, on either side of a positioning boundary, are relatively easy to achieve.

FIGS. 8 to 14 more particularly concern a transmission of motion independent of the stress transmitted, particularly of the torque transmitted.

Figure 8:
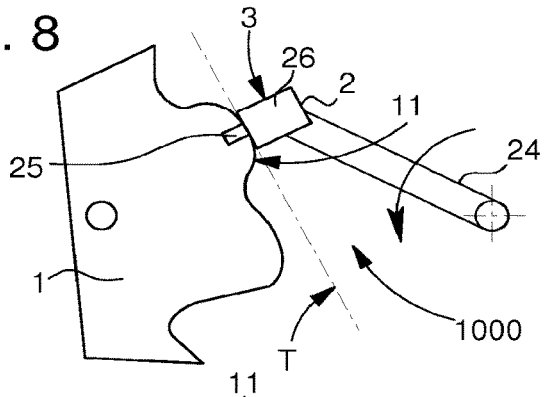
FIGS. 8 to 23 illustrate schematic, partial and plan views of variants of implementation of the invention, in plane configurations.

In FIG. 8, first component 1 extends in a plane, and first component 1 may have any contour according to the x and y coordinates in this plane, the thickness of first component 1 is constant, and second component 2 consists of two masses 25 and 26, which consist here, in a non-limiting manner, of parallelepiped prisms, of the same thickness but of different width in direction T tangent to first component 1 in interface area 3, and arranged end-to-end. If a stress, particularly a torque, is applied to second component 2, the latter will still be positioned such that the edge 11 of first component 1 in intersection and interface area 3 is positioned at the boundary between the two masses 25 and 26, as seen in FIG. 8.

Figure 9:
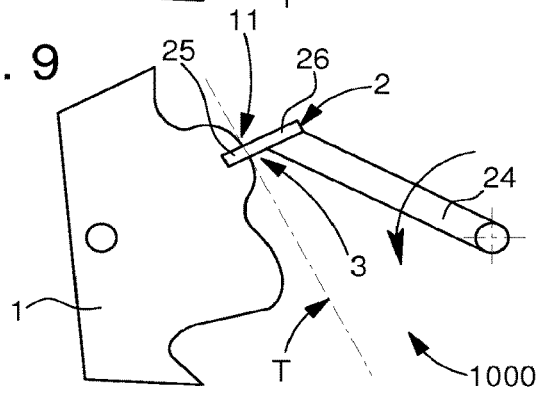

FIG. 9 illustrates a similar configuration, wherein the two masses 25 and 26 are of the same width but of different height, as may also be the case in FIG. 7.

Figure 10:
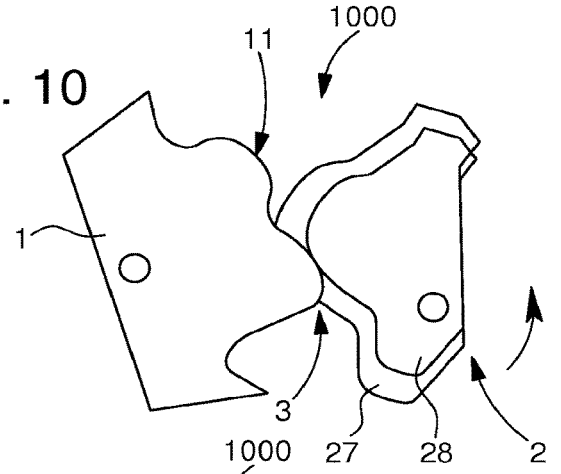

A generalisation of the preceding variants consists of constructing a cam-to-cam transmission, wherein first component 1 and second component 2 may have any peripheral contours, and be made in different forms, including that of a gear train. FIG. 10 illustrates such a case, with a first component 1 extending over a single level, and a second component 2 comprising a first level 27 and a second level 28, superposed and extending beyond each other in places. In particular, this variant can be achieved simply via a simple difference in thickness at the periphery of second component 2.

Figure 11:
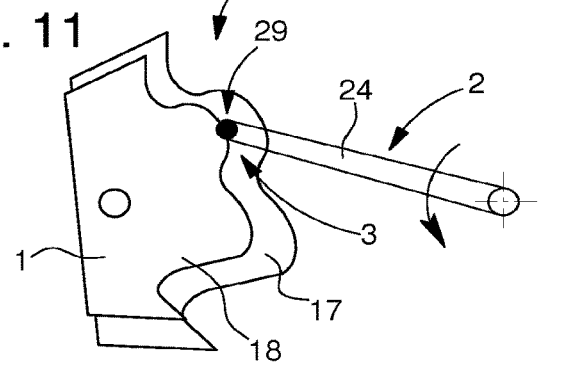
Figure 12:
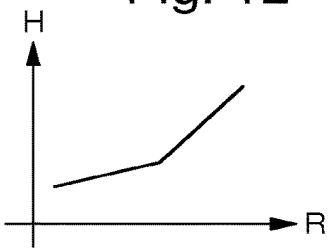

Another variant consists in combining an extended component and a substantially punctiform component, as seen in FIG. 11, where second component 2 comprises a substantially punctiform stylus 29 at the end of an arm 24. Here it is first component 1 that comprises a first level 17 and a second level 18, which are superposed and extend beyond each other in places. In particular, this variant can be achieved simply via a simple difference in thickness at the periphery of first component 1, where acting on different height gradients H on first component 1 generates the two energy interaction slopes, as seen in FIG. 12, with height H of first component 1 on the ordinate, and the radial coordinate R on the abscissa.

Figure 13:
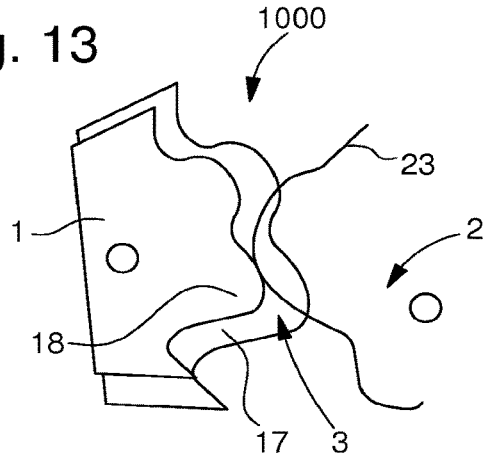
Figure 14:
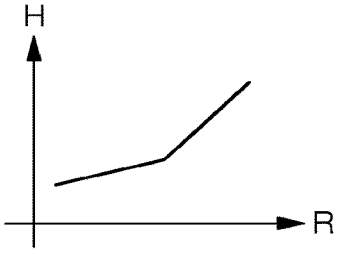

FIG. 13 illustrates a variant close to that of FIG. 11, where one of the components present, here second component 2, carries an element of curvilinear contour 23, which is not necessarily flat, and which corresponds to integration of the punctiform component of FIG. 11 along a contour. This element of curvilinear contour 23 of second component 2 can be extended tangentially, in immediate proximity to first component 1, but with a very small radial dimension, said element 23 may be considered to be wired. FIG. 14 is similar to FIG. 12 above.

FIGS. 15 to 19 more particularly concern the transmission of a stress independent of the motion of the components of mechanism 100

Not only is the position well defined at the break in the slope, but the magnetic and/electrostatic interaction energy is also clearly determined, as seen below. This is applicable to the different variants described in a non-limiting manner above.

A transformation based on the mechanism of FIG. 8, as seen in FIG. 18, allows first component 1 to exchange energy with second component 2 independently of the motion of second component 2. In this non-limiting example, first component 1 comprises two areas 12 and 13 of different thickness, between which there may be a transition area 14. When first component 1 is in motion, particularly pivoting, and the active part of second component 2 moves, in the example of FIG. 18, from area 12 to area 13, a stress, particularly a torque, is exerted by first component 1 on second component 2. By acting on the thicknesses of areas 12 and 13, it is possible to vary this exchanged stress, without thereby changing the kinematics.

All the examples of FIGS. 9 to 13 can, in a similar manner, also be generalised to a variable transmission of stress, notably of torque. They can also be generalised to the case where one of the slopes is zero. FIG. 19 shows such an example, where the interaction between the two components is one of attraction, whereas in the other illustrated embodiments the interaction is preferably one of repulsion.

Figure 15:
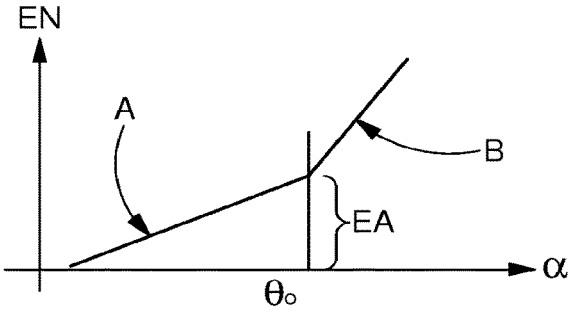

FIG. 15, like FIG. 1, represents the accumulated energy EA which can be returned, and which corresponds to the energy level at the break in the slope close to transition angle θ0.

Figure 16:
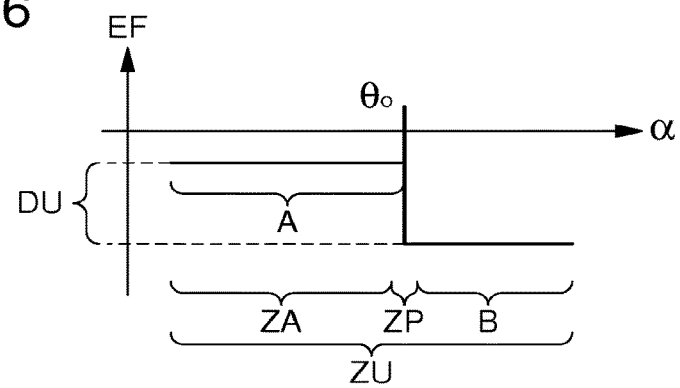
Figure 17:
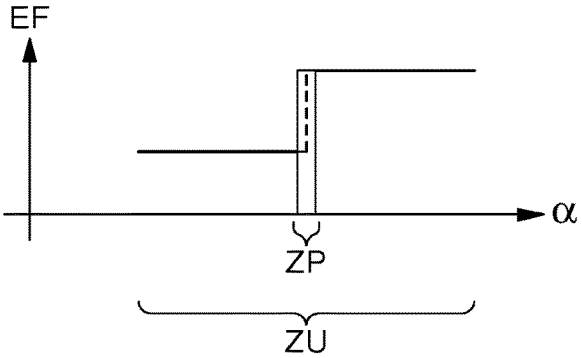

FIG. 16, like FIG. 2, represents the range of useful stress DU (particularly of useful torque, which corresponds to the difference on the ordinate between the stress levels of areas A and B, whereas the abscissa represents the useful area of mechanical motion ZU, which includes an area of accumulation ZA, particularly of magnetic and/or electrostatic accumulation, and a narrow area of positioning ZP, particularly magnetic and/or electrostatic positioning, in proximity to transition angle θ0. FIG. 17 shows the opposite configuration where the stress levels are positive.

FIGS. 20 to 23 illustrates several concrete, non-limiting examples of application to horology.

Figure 20:
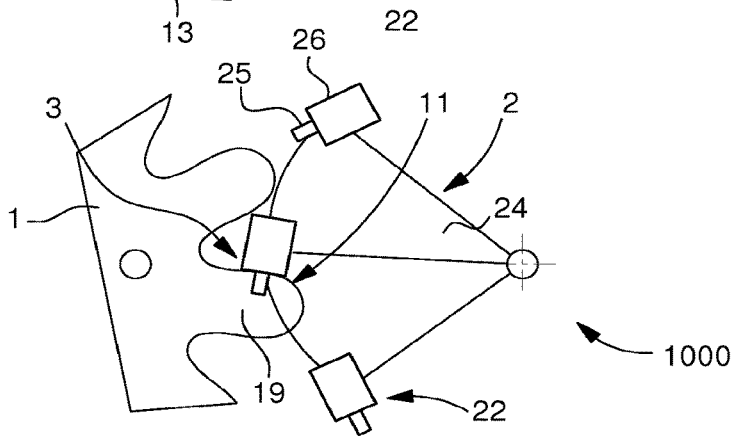
Figure 21:
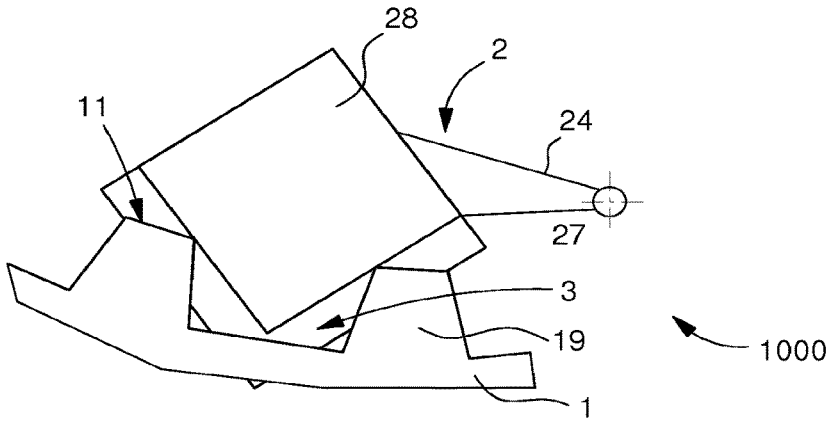

FIG. 20 illustrates a gear, wherein first component 1 and second component 2 are both comparable to toothed wheels. First component 1 comprises, in this non-limiting example, protuberances 19, which cooperate with a series of notional teeth 22 mounted on spokes 24 of second component 2, each of these notional teeth 22 comprising two masses 25 and 26 similar to those of FIG. 8 or to those of FIG. 9, and whose cooperation with edge 11 of first component 1 is similar to that described above with reference to FIGS. 8 and 9. FIG. 21 illustrates a detail of a jumper spring cooperating with a date star-wheel or similar, with the interaction of a pallet-stone, formed by a second component 2 with two levels 27 and 28 as in FIG. 10, with teeth-like protuberances 19 of a first component 1.

Figure 22:
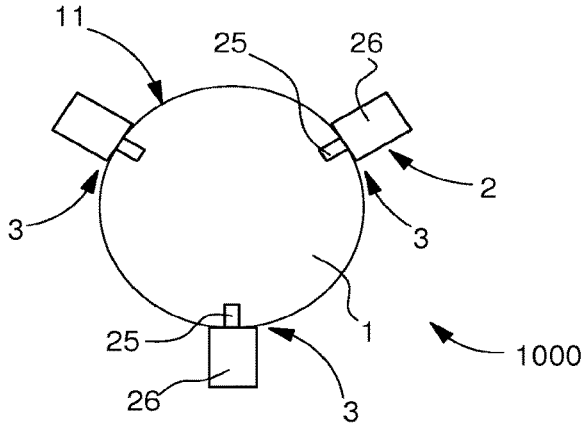
Figure 23:
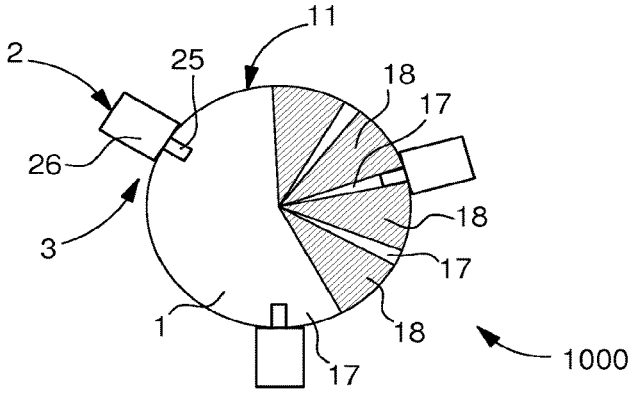
Figure 24:
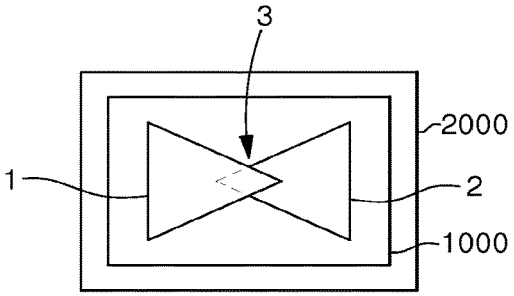
FIG. 24 is a block diagram representing a timepiece comprising a mechanism according to the invention with a first component and a second component in contactless interaction.
Figure 25:
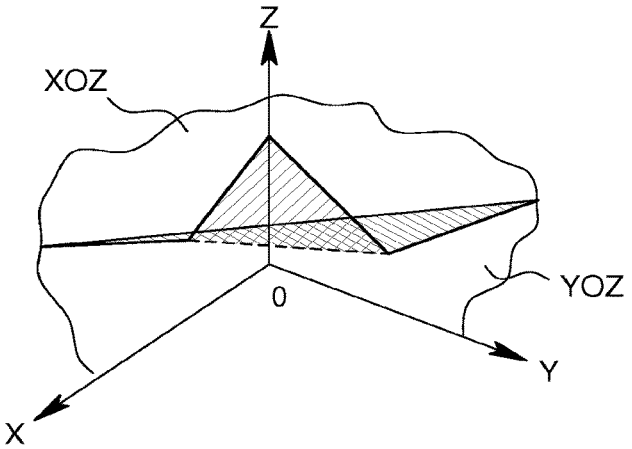
FIG. 25 illustrates the theoretical and simplified combination, in space, of a first energy diagram according to FIG. 1 in a first plane XOZ, and a second energy diagram in a second plane YOZ together defining two surfaces whose boundary corresponds to a jump in energy.

FIG. 22 illustrates the guiding of a first component 1, for example during pivoting, between fixed second components 2 each acting as a peripheral runner and each comprising two masses 25 and 26, similar to those of FIG. 8 or to those of FIG. 9, and whose cooperation with edge 11 of first component 1 is similar to that described above with reference to FIGS. 8 and 9; since there is no mechanical contact and therefore no losses due to friction, play-free guiding is thus achieved. FIG. 23 combines the guiding function of FIG. 22 and a jumper spring function, and, to this end, first component 1 comprises alternating sectors of different levels 17 and 18, as in the FIG. 11 embodiment.

Without illustrating all the possible watchmaking applications, of which there are many, the following can also be cited by way of non-limiting examples:

- achieving a transformation of motion by means of a cam: first component 1 has the contour of a cam, second component 2 has the contour of a lever on which a spring rests. Rotating the cam winds or relaxes the spring. An example application is a release spring for an instantaneous date mechanism;
- achieving an initialisation function by means of a heart-piece: first component 1 has the contour of a chronograph-heart, and second component 2 adopts the contour of a hammer that presses the heart-piece to return the counter to zero.
- achieving a holding function by means of a jumper spring: first component 1 has, for example a similar contour to that of a date-disc with teeth, and second component 2 has the contour of a jumper spring that positions in the disc in discrete positions. Second component 2 can be mounted to pivot about an axis, with a return spring, or be immobile, it is the magnetic and/or electrostatic potential that ensures positioning;
- achieving a striking mechanism, symbolised in FIG. 26, with a first component 1 and a second component 2, one of which replaces the winding spring, and the other the counter spring.

The invention allows for many configurations, by acting, in particular, on several degrees of freedom at the same time.

FIG. 27 illustrates the cooperation between a flat cam 80 and an actuator 85. Cam 80, whose radial cross-section varies between a maximum 81 and a minimum 82, is represented here substantially in the form of a three-lobed element whose radial protuberances are also the areas of greatest cross-section. This cam 80 pivots about a pivot 83 carried by an arm 84. Actuator 85 is a double actuator, and has a T-shaped profile on either side of the periphery of cam 80: the vertical bar 86, 88 of the T is arranged to be superposed on the cam periphery, and the crossbar 87, 89 is arranged to mark a stop on the outer edge 90 of cam 80.

In one degree of freedom the slope may be zero.

And, in another degree of freedom, it is easy to vary the width of cam 80 in the area of cooperation with actuator 85.

FIG. 28 represents, in a dotted line and dot and dash line, two different relative positions of the T with respect to the cam;

- a first position where the distal end of the vertical bar 86 reaches the outer edge 90 of cam 80, the energy level in FIG. 29 is in that case zero;
- a second position where the distal end of the vertical bar 86 reaches the inner edge 91 of cam 80, the energy level in FIG. 29 is in that case constant at a level E1, until crossbar 87 reaches the stop position at outer edge 90 of the cam.

The variable radial cross-section of the cam determines the length of the ramp.

The radial peaks and troughs of the cam profile make it possible to modify the point of application of the barrier stop.

The combination of the cross-section and positions of the peaks and troughs thus allow the variation in energy E1 of actuator 85 to be modified as required with respect to the field between actuator 85 and cam 80.

In a particular simplified embodiment, using repulsion, cam 80 is magnetically charged.

It is noted that, in this embodiment, the air gap is always identical, which ensures proper operation.

In short, in this mechanism of FIG. 27, which corresponds to the case where one of the gradients is zero, as seen in FIG. 29, there is an energy level of variable size: the first component formed by the actuator moves in a first degree of freedom, which is in translation here, whereas the second component formed by cam 80 moves in a second degree of freedom, in rotation, and it is the useful width of the cam facing the actuator that determines the size of the ramp, and thus the height of the energy level. The energy level of the position of discontinuity varies when the second degree of freedom of the first or second component varies.

This mechanism, which works in two degrees of freedom, is easy to achieve and compact, in both magnetic and electrostatic embodiments, and is well-suited to varied applications, such as a calendar release cam, where its configuration can overcome the ever difficult constraints associate with the transmission of high torque from the jumper spring at significant speed, or a minute-repeater control mechanism, or a chronograph-heart, which require constant torque transmission to overcome constant friction and wherein, when high instantaneous torque is exerted during a return-to-zero, the transmission of speed must be regulated, and wherein the penetration ramp of vertical bar 86 on cam 80 is sufficient to perform this function.

FIGS. 30 and 31 represent a variant with a three-dimensional cam 70 with both radial and height variations, wherein two warped surfaces intersect at a warped interface curve 75, the cam being shown cooperating with a cylindrical type feeler-spindle 76. The Figures show a three-lobed shape with, on a first side of interface curve 15, surfaces that are solid 71 and hollow 72, all with a smaller slope with respect to a reference plane 77 than the corresponding surfaces 73, 74 located on either side of curve 75. In a simplified embodiment represented in the Figures, the slope of the surfaces located on the same side of curve 75 is always the same, it is only their width that varies (from E1 to E2 in FIG. 31). The energy level thus varies according to the position of the point of contact on the cam periphery. Naturally, in a more complex embodiment, both the slope and the height of curve 75 can be varied with respect to plane 77.

The invention also concerns a timepiece 2000 including at least one such mechanism 1000, timepiece 2000 is notably a watch. It is understood that such a mechanism 1000 can be incorporated in the movement, or in an additional mechanism such as a striking mechanism or suchlike, or in an additional module or other element. The only limitations are for the protection of the other components or sub-assemblies of the timepiece with respect to the magnetic and/or electrostatic fields implemented, in particular if some of the sub-assemblies utilise magnetic and/or electrostatic fields for their own operation.

The invention claimed is:

1. A timepiece mechanism comprising:

at least a first component and a second component configured to cooperate with each other in a relative motion on a trajectory in an interface area, wherein a first path of the first component includes first actuation means configured to exert a contactless stress on second complementary actuation means comprised in a second path belonging to the second component, wherein, throughout a monotonous relative movement of the second path with respect to the first path, a change of interaction energy between the first component and the second component based on a change of a relative angle has a variable and a linear non-zero gradient, the gradient having at least one change point, the change point of the gradient corresponding to a transition angle, a level of the contactless stress being changed at the transition angle, and wherein the relative angle is formed by the first component and the second component when the second component pivots to the first component, the second component being configured to adjust a position at the transition angle independent of the contactless stress applied to the second component.

2. The timepiece mechanism according to claim 1, wherein the first component moves in at least a first degree of freedom, wherein the first or second component moves in at least a second degree of freedom distinct from the first degree of freedom, and wherein a level of interaction energy at the change point of the gradient varies when the second degree of freedom of the first or second component varies.

3. The mechanism according to claim 1, wherein a range of torque is applied to the second component between a first torque value and a second torque value, wherein the relative angle remains fixed at the transition angle, independent of the torque applied to the second component when a value of the torque applied to the second component is greater than an absolute value of the first torque value and smaller than an absolute value of the second torque value, the transition angle corresponding to the change point of the gradient as a function of the relative angle between a first gradient in a first stress area corresponding to the first torque value, and a second gradient in a second stress area corresponding to the second torque value, the second gradient having a greater absolute value than the first gradient.

4. The mechanism according to claim 1, wherein the second complementary actuation means includes at least one area of penetration close to and distinct from a blocking area, which cooperate differently with the first actuation means, and at a boundary of the change point of the gradient.

5. The mechanism according to claim 4, wherein a barrier area corresponds to the change point of the gradient.

6. The mechanism according to claim 1, wherein the cooperation between the first actuation means and the second complementary actuation means makes it possible, in certain first relative positions of the first component and of the second component, to synchronize speed or position thereof, and, in certain other second relative positions of the first component and of the second component, to allow one of the first or second components to move with respect to the other under action of a force and/or a torque.

7. The mechanism according to claim 1, wherein one of the first component and one of the second component are configured to cooperate with each other in a relative motion on a repetitive trajectory in an interface area.

8. The mechanism according to claim 1, wherein, at least in proximity to a limit position, the first actuation means exerts a first substantially constant stress on a penetration area.

9. The mechanism according to claim 8, wherein, in proximity to the limit position, a particular curvilinear contour of the first component faces a barrier area of the second component.

10. The mechanism according to claim 9, wherein the gradient is greater in a second stress area than in a first stress area.

11. The mechanism according to claim 10, wherein the at least a first component and the at least a second component interact with each other via action of magnetic or respectively electrostatic fields, and wherein the first stress area corresponds to an accumulation of magnetic or respectively electrostatic energy during a relative motion between the at least a first component and the at least a second component.

12. The mechanism according to claim 11, wherein energy accumulated in the first stress area, during monotonous relative motion of the second path with respect to the first path, up to a position at a change of the gradient, is constant and fixed by a design of the mechanism.

13. The mechanism according to claim 12, wherein, when the change point of the gradient is crossed, stored energy is returned in a same degree of freedom or in at least one other degree of freedom.

14. The mechanism according to claim 12, wherein, in the first stress area and the second stress area, the gradient is created by continuous variation of a physical parameter that contributes to magnetic or respectively electrostatic interaction between the at least a first component and the at least a second component.

15. The mechanism according to claim 1, wherein, at least in proximity to a limit position, the first actuation means exerts a second substantially constant stress on a blocking area.

16. The mechanism according to claim 1, wherein the mechanism further comprises:

one of the first component and one of the second component, which are configured to effect a relative motion in a useful area, the useful area includes a first part corresponding to a first stress area in which a relative torque or stress exerted by one of the components on the other is at a first level, and a second part corresponding to a second stress area in which the relative torque or stress exerted by one of the components on the other is at a second level, different from the first level, at least around a given position, such that, at an interface at a boundary between the first stress area and the second stress area, the first component and the second component are precisely positioned with respect to each other, for a determined useful stress range.

17. The mechanism according to claim 16, wherein in the first stress area, the relative torque or stress exerted by one of the components on the other is substantially constant at the first level, and wherein in the second stress area, the relative torque or stress exerted by one of the components on the other is substantially constant at the second level, which is different from the first level.

18. The mechanism according to claim 1, wherein the change point of the gradient, which corresponds to a variation in the contactless stress, is at a start, or at an end, of driving of one of the first component and the second component by the other.

19. A timepiece comprising at least one mechanism according to claim 1, wherein the timepiece is a watch.

* * * * *